US008786512B2

(12) United States Patent
Shih et al.

(10) Patent No.: US 8,786,512 B2
(45) Date of Patent: Jul. 22, 2014

(54) DUAL-POLARIZED ANTENNA

(75) Inventors: Fu-Jen Shih, Taipei (TW); Kuo-Pin Hsu, Taipei (TW); Yi-Teng Hsiao, Taipei (TW)

(73) Assignee: Cipherlab Co., Ltd., Taipei (TW)

( * ) Notice: Subject to any disclaimer, the term of this patent is extended or adjusted under 35 U.S.C. 154(b) by 317 days.

(21) Appl. No.: 13/357,480

(22) Filed: Jan. 24, 2012

(65) Prior Publication Data

US 2013/0120215 A1 May 16, 2013

(30) Foreign Application Priority Data

Nov. 11, 2011 (TW) ..... 100221362 U

(51) Int. Cl.
*H01Q 7/00* (2006.01)

(52) U.S. Cl.
USPC ..... 343/848

(58) Field of Classification Search
USPC ..... 343/846–848, 700 MS, 702
See application file for complete search history.

(56) References Cited

U.S. PATENT DOCUMENTS

| | | | | |
|---|---|---|---|---|
| 6,982,675 | B2 * | 1/2006 | Kwak et al. | 343/702 |
| 7,026,999 | B2 * | 4/2006 | Umehara et al. | 343/702 |
| 2002/0101381 | A1 * | 8/2002 | Segerstedt | 343/702 |
| 2003/0058177 | A1 | 3/2003 | Nishikido et al. | |
| 2006/0057987 | A1 | 3/2006 | Nail et al. | |
| 2007/0096992 | A1 | 5/2007 | Fujii | |
| 2010/0045553 | A1 | 2/2010 | Ohira et al. | |
| 2010/0245195 | A1 * | 9/2010 | Wilson | 343/750 |
| 2010/0321253 | A1 * | 12/2010 | Ayala Vazquez et al. | 343/702 |
| 2011/0193756 | A1 | 8/2011 | Cheng et al. | |

FOREIGN PATENT DOCUMENTS

| | | | |
|---|---|---|---|
| EP | 1 182 727 | A2 | 2/2002 |
| TW | 2009-33985 | A | 8/2009 |
| WO | 01/45200 | A1 | 6/2001 |
| WO | 20081075156 | A1 | 6/2008 |

OTHER PUBLICATIONS

European Search Report dated Jan. 7, 2014 in application No. 12152410.2.

* cited by examiner

*Primary Examiner* — Huedong Mancuso
(74) *Attorney, Agent, or Firm* — Maschoff Brennan

(57) ABSTRACT

A dual-polarized antenna includes a ground plane, an inverted-F conductor unit with an inverted-F plane, an inverted-L conductor unit with an inverted-L plane and a stretched ground conductor unit with a T-shaped plane. The inverted-F plane is vertically connected to the inverted-L plane, the T-shaped plane and the ground plane respectively, and the T-shaped plane is vertically connected with the ground plane. Therefore, the inverted-F plane, the inverted-L plane and the stretched ground conductor unit correspond to each side of the ground plane respectively to form a dual-polarized radiation field.

17 Claims, 8 Drawing Sheets
(2 of 8 Drawing Sheet(s) Filed in Color)

DUAL-POLARIZED ANTENNA

CROSS-REFERENCE TO RELATED APPLICATIONS

This non-provisional application claims priority under 35 U.S.C. §119(a) on Patent Application No(s). 100221362 filed in Taiwan, R.O.C. on Nov. 11, 2011, the entire contents of which are hereby incorporated by reference.

BACKGROUND

1. Technical Field

The disclosure relates to a dual-polarized antenna and more particularly to a dual-polarized antenna with a plurality of conductor sections applicable for radio frequency identification read-write devices.

2. Related Art

With a quantum jump in technology and the awakening awareness of consumers, many consumers are starting to demand that origins of products and procedures of products are transparent and can be identified, therefore radio frequency identification (RFID) technology is widely used in product controlling and management, product identification and inquiry of production records.

Radio frequency identification (RFID) technology is commonly referred to comprising a data circuit which communicates electronically with at least one antenna, such as small sized label of semi-conductor chip, wherein the coded information in the data circuit can be transmitted wirelessly to an external reading device. Radio frequency identification labels can be passive, that means an internal power supply is not required, but the radio frequency identification labels rely on energy received from a wireless radio frequency source through the antenna to operate and transmit signals; or they can be active, that means a battery is used for power supply. Radio frequency identification circuit is commonly used with dual-polarized antenna to operate.

In the future, products applying the radio frequency identification technology will be found everywhere, and will even be introduced into certain supply chains for tracking products. Therefore, dimensions, radiation efficiency and manufacturing costs of the dual-polarized antenna in radio frequency identification circuit will be the primary considerations in design and production for manufacturers.

SUMMARY

A dual-polarized antenna disclosed in the disclosure includes a ground plane, an inverted-F conductor unit and an inverted-L conductor unit. The inverted-F conductor unit is disposed on the ground plane and the inverted-F conductor includes a first stretched conductor section, a signal-feeding conductor section and an arm conductor section. A first end of the first stretched conductor section is extended from the ground plane. A side of the signal-feeding conductor section perpendicular to the ground plane is parallel to a side of the first stretched conductor section perpendicular to the ground plane, and a first end of the signal-feeding conductor section is connected with the ground plane through a signal-feeding cable. A first end of a first side of the arm conductor section is connected with a second end of the first stretched conductor section and a second end of the signal-feeding conductor section to form an inverted-F plane. The inverted-L conductor unit is connected with the inverted-F conductor unit, and a surface of the inverted-L conductor unit, the inverted-F plane of the inverted-F conductor unit and a surface of the ground plane are perpendicular to each other.

A dual-polarized antenna disclosed in the disclosure includes a ground plane, a first stretched conductor section, a signal-feeding conductor section, a first arm conductor section, an inverted-L conductor unit and a stretched ground conductor unit. A first end of the first stretched conductor section is extended vertically from the ground plane. The signal-feeding conductor section is parallel to the first stretched conductor section, and a first end of the signal-feeding conductor section is vertically connected with the ground plane through a signal-feeding cable. A first end of a first side of the first arm conductor section is connected with a second end of the first stretched conductor section and a second end of the signal-feeding conductor section, so that the first arm conductor section, the first stretched conductor section and the signal-feeding conductor section are combined to form an inverted-F plane. The inverted-L conductor unit is connected with the first arm conductor section, and a surface of the inverted-L conductor unit, a surface of the first arm conductor section and a surface of the ground plane are perpendicular to each other. The stretched ground conductor unit is extended vertically from the ground plane, and the stretched ground conductor unit is connected with the inverted-F plane.

The present invention will become more fully understood by reference to the following detailed description thereof when read in conjunction with the attached drawings.

BRIEF DESCRIPTION OF THE DRAWINGS

The patent or application file contains at least one drawing executed in color. Copies of this patent or patent application publication with color drawing(s) will be provided by the Office upon request and payment of the necessary fee. The present disclosure will become more fully understood from the detailed description given herein below for illustration only, and thus are not limitative of the present disclosure, and wherein.

DETAILED DESCRIPTION

In view of the abovementioned demands, the disclosure provides a dual-polarized antenna, and an applicability of the dual-polarized antenna can be enhanced by reducing dimensions of the antenna, enhancing a radiation efficiency of the antenna and reducing the production costs.

Figure 1:
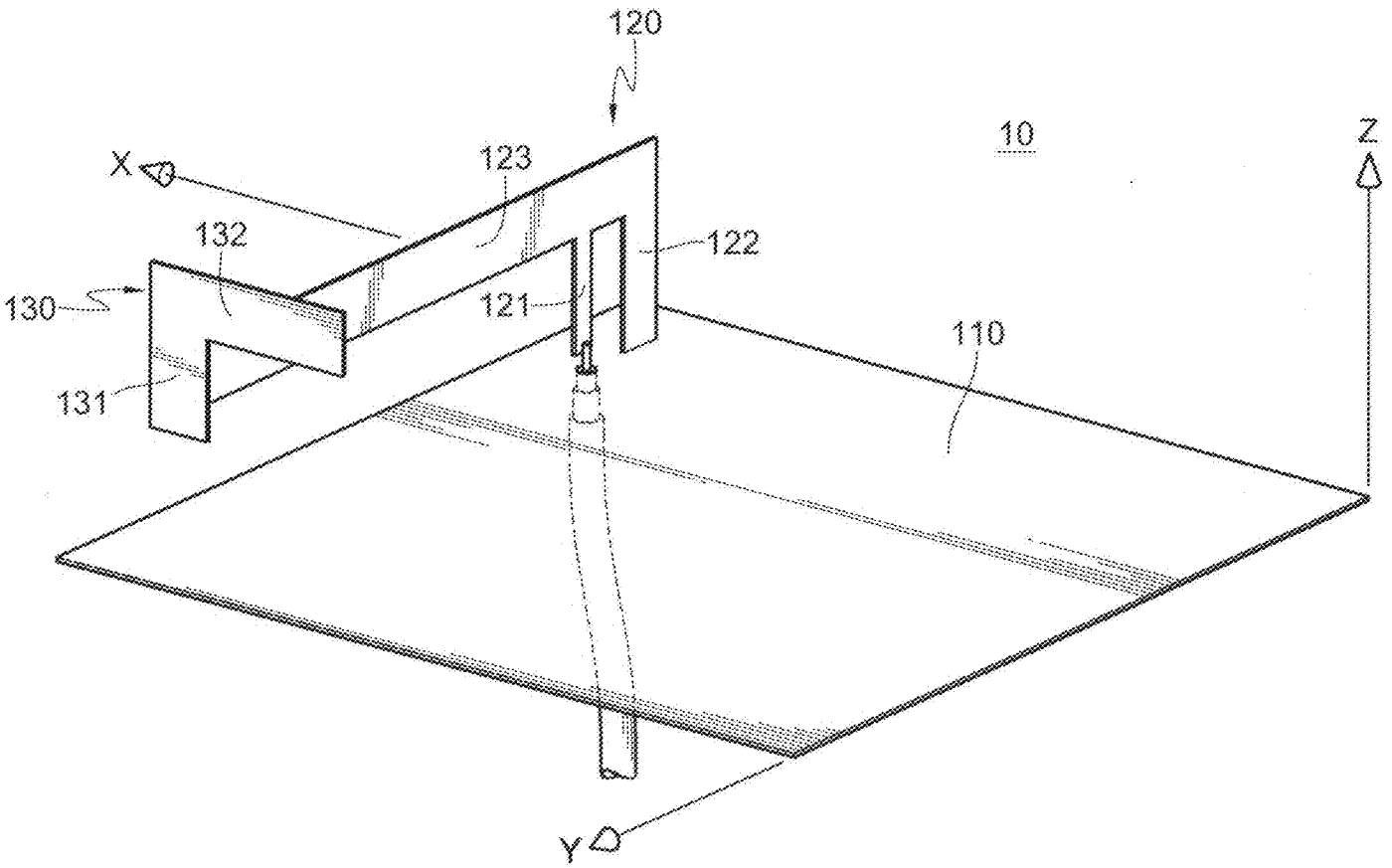
FIG. 1 is structural view of a dual-polarized antenna of a first embodiment according to the disclosure.
Figure 2:
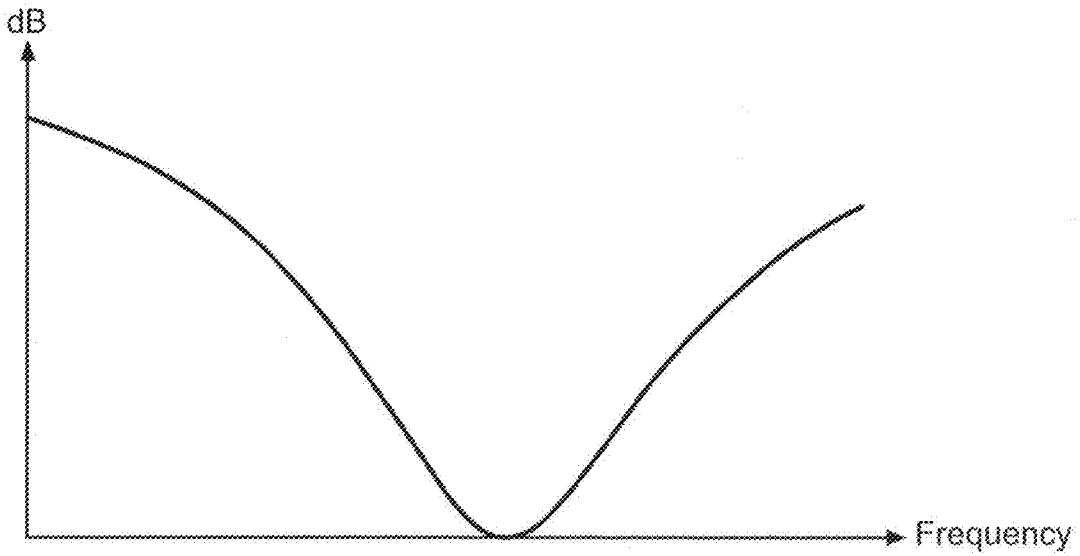
FIG. 2 is a curve of a reflection coefficient of a dual-polarized antenna in 865 MHz of a first embodiment according to the disclosure.
Figure 3A:
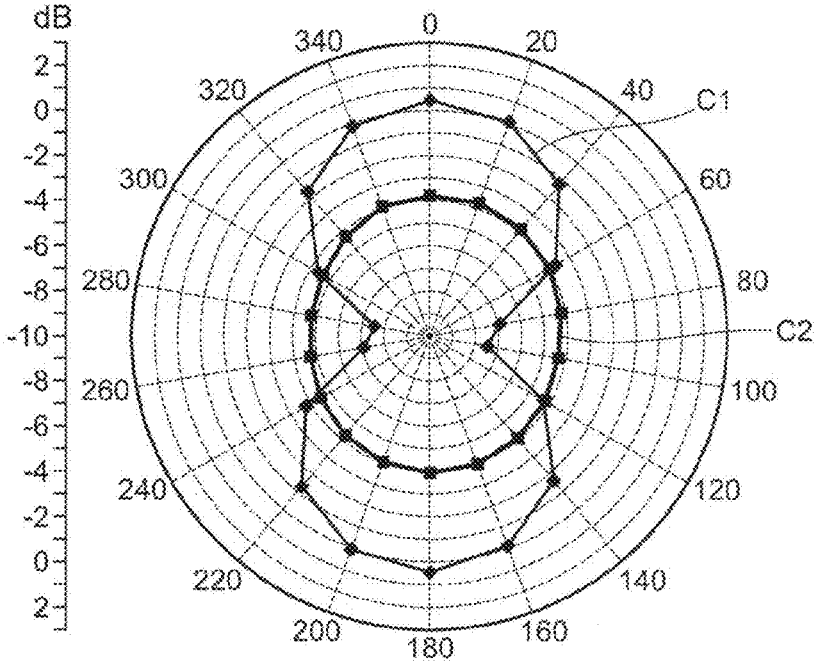
FIG. 3A is a two-dimensional radiation pattern on an X-Z or Y-Z plane of a dual-polarized antenna in 865 MHz of a first embodiment according to the disclosure.
Figure 3B:
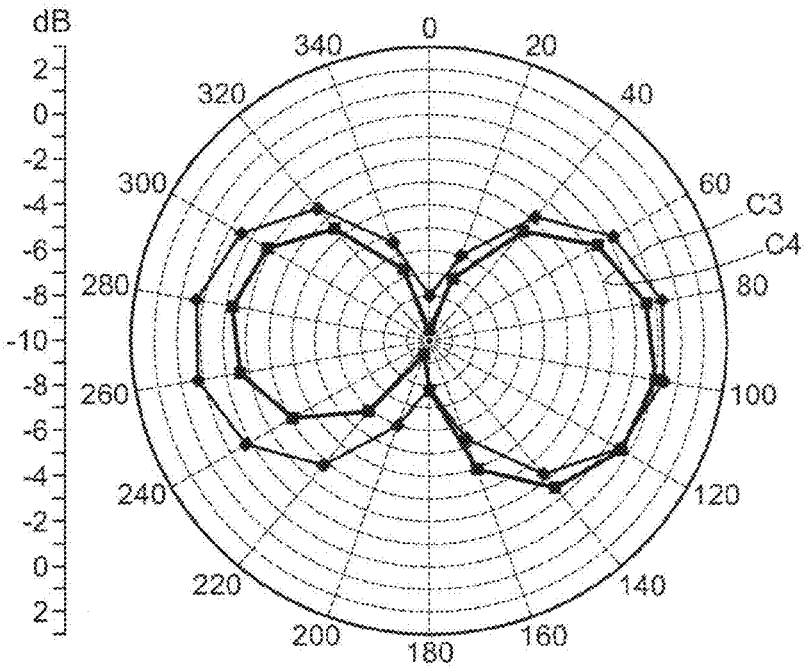
FIG. 3B is a two-dimensional radiation pattern on an X-Y plane of a dual-polarized antenna in 865 MHz of a first embodiment according to the disclosure.
Figure 7:
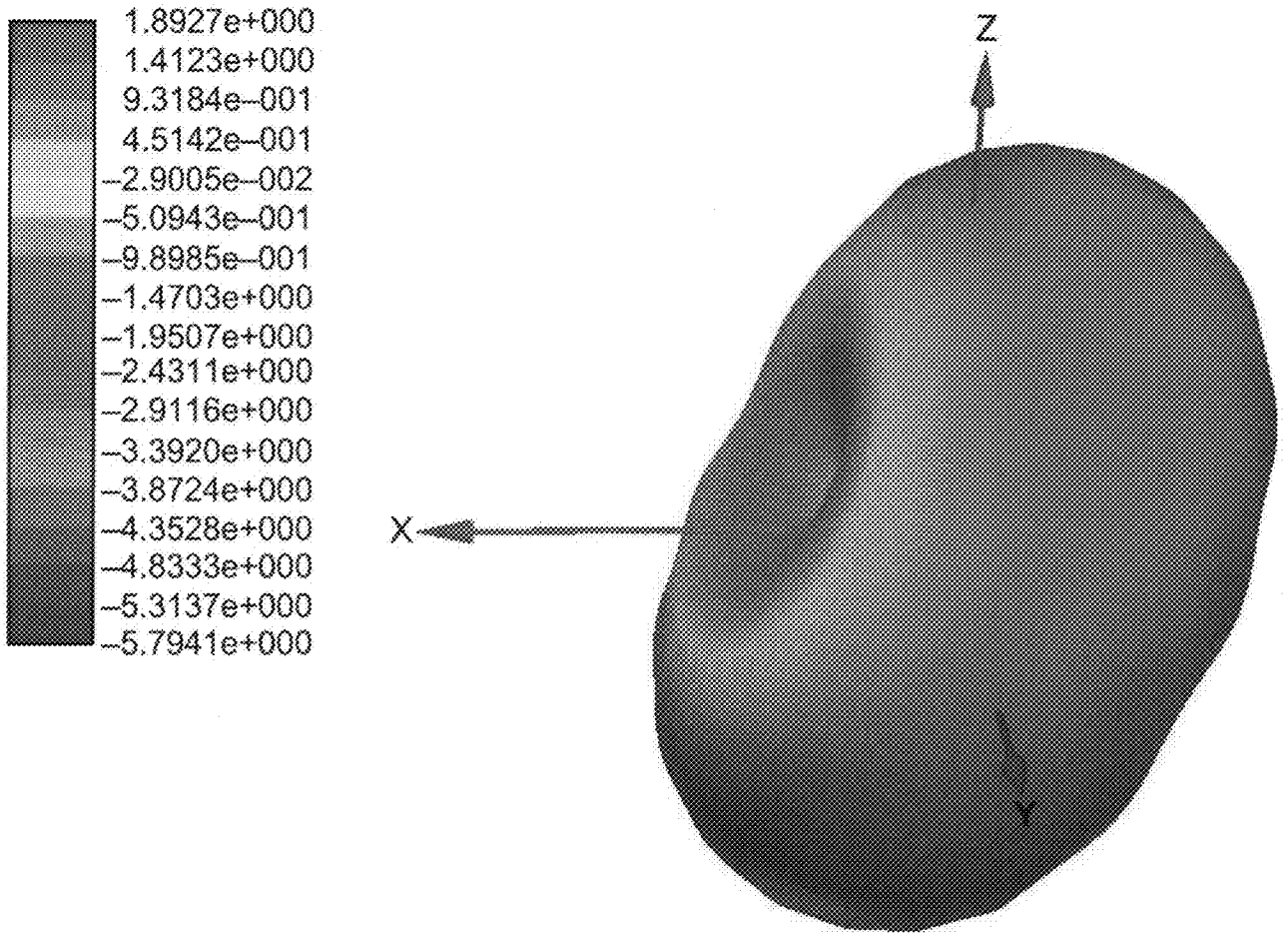
FIG. 7 is a three-dimensional radiation pattern on an X-Y plane of a dual-polarized antenna in 865 MHz of a first embodiment according to the disclosure.

Referring to FIGS. 1 to 3B and FIG. 7, FIG. 1 is structural view of a dual-polarized antenna of a first embodiment according to the disclosure, FIG. 2 is a curve of a reflection coefficient of a dual-polarized antenna in 865 MHz of a first embodiment according to the disclosure, FIG. 7 is a three-dimensional radiation pattern on an X-Y plane of a dual-polarized antenna in 865 MHz of a first embodiment according to the disclosure, FIG. 3A is a two-dimensional radiation pattern on an X-Z or Y-Z plane of a dual-polarized antenna in 865 MHz of a first embodiment according to the disclosure, FIG. 3B is a two-dimensional radiation pattern on an X-Y plane of a dual-polarized antenna in 865 MHz of a first embodiment according to the disclosure.

A dual-polarized antenna 10 of the disclosure includes a ground plane 110, an inverted-F conductor unit 120 and an inverted-L conductor unit 130. The inverted-F conductor unit 120 and the inverted-L conductor unit 130 are disposed on the ground plane 110, the inverted-F conductor unit 120 is vertically connected with the ground plane 110, while the inverted-L plane 130 is vertically connected with the inverted-F conductor unit 120. Therefore, the inverted-F plane 120, the inverted-L plane 130 and the ground plane 110 are perpendicular to each other.

The inverted-F conductor unit 120 includes a signal-feeding conductor section 121, a stretched conductor section 122 and an arm conductor section 123. A first end of the signal-feeding conductor section 121 is connected with the ground plane 110 through a signal-feeding cable (not numbered), therefore there is a signal-feeding point at the connection between them. A first end of the stretched conductor section 122 is vertically extended from a surface of the ground plane 110, and a side of the stretched conductor section 122 perpendicular to the ground plane 110 is parallel to a side of the signal-feeding conductor section 121 perpendicular to the ground plane 110. A first end of a first side of the arm conductor section 123 is connected with a second end of the signal-feeding conductor section 121 and a second end of the stretched conductor section 122 respectively. A surface of the signal-feeding conductor section 121, a surface of the stretched conductor section 122 and a surface of the arm conductor section 123 are combined to form an inverted-F plane, and the inverted-F plane is perpendicular to the ground plane 110; in other words, the surface of the signal-feeding conductor section 121, the surface of the stretched conductor section 122 and the surface of the arm conductor section 123 are all perpendicular to the ground plane 110.

The inverted-L conductor unit 130 includes a stretched conductor section 131 and a branch arm conductor section 132. A first end of the stretched conductor section 131 is extended from a second side of the arm conductor section 123, and the second side of the arm conductor section 123 is adjacent and perpendicular to the first side of the arm conductor section. A first end of the branch arm conductor section 132 is connected to a second end of the stretched conductor section 131. A surface of the stretched conductor section 131 and a surface of the branch arm conductor section 132 are combined to form a surface of the inverted-L conductor unit 130, which is an inverted-L plane. The inverted-L plane is perpendicular to the ground plane 110, which means the surface of the stretched conductor section 131 and the surface of the arm conductor section 132 are perpendicular to the ground plane 110.

A total length of the stretched conductor section 122, the arm conductor section 123, the stretched conductor section 131 and the branch arm conductor section 132 is a quarter of an operating wavelength of the dual-polarized antenna 10. A boundary where the inverted-L conductor unit 130 and the arm conductor section 123 are connected is the second side of the arm conductor section 123. The second side of the arm conductor section 123 is adjacent to and perpendicular to the first side of the arm conductor section 123 which is connected to the signal-feeding conductor section 121 and the stretched conductor section 122. The inverted-F plane of the inverted-F conductor unit 120 and the inverted-L plane of the inverted-L conductor unit 130 correspond to two adjacent sides of the ground plane 110 respectively. The inverted-F plane is perpendicular to the inverted-L plane.

A radiation intensity of the dual-polarized antenna 10 increases gradually from the stretched conductor section 122 to the inverted-L conductor unit 130. A ratio of lengths of the stretched conductor section 131 and the branch arm conductor section 132 of the inverted-L conductor unit 130, as well as a ratio of lengths of the stretched conductor section 122 and the arm conductor section 123 of the inverted-F conductor unit 120 can be designed according to an applied device, provided that the total length of the stretched conductor section 122, the arm conductor section 123, the stretched conductor section 131 and the branch arm conductor section 132 is a quarter of an operating wavelength of the dual-polarized antenna 10.

A radiation of the dual-polarized antenna 10 in a Z-axis direction is shown in a radiation pattern in FIG. 7. As shown in FIGS. 3A and 3B, curves C1 and C3 are acquired by measuring in 90 degrees, while curves C2 and C4 are acquired by measuring in zero degree.

Figure 4:
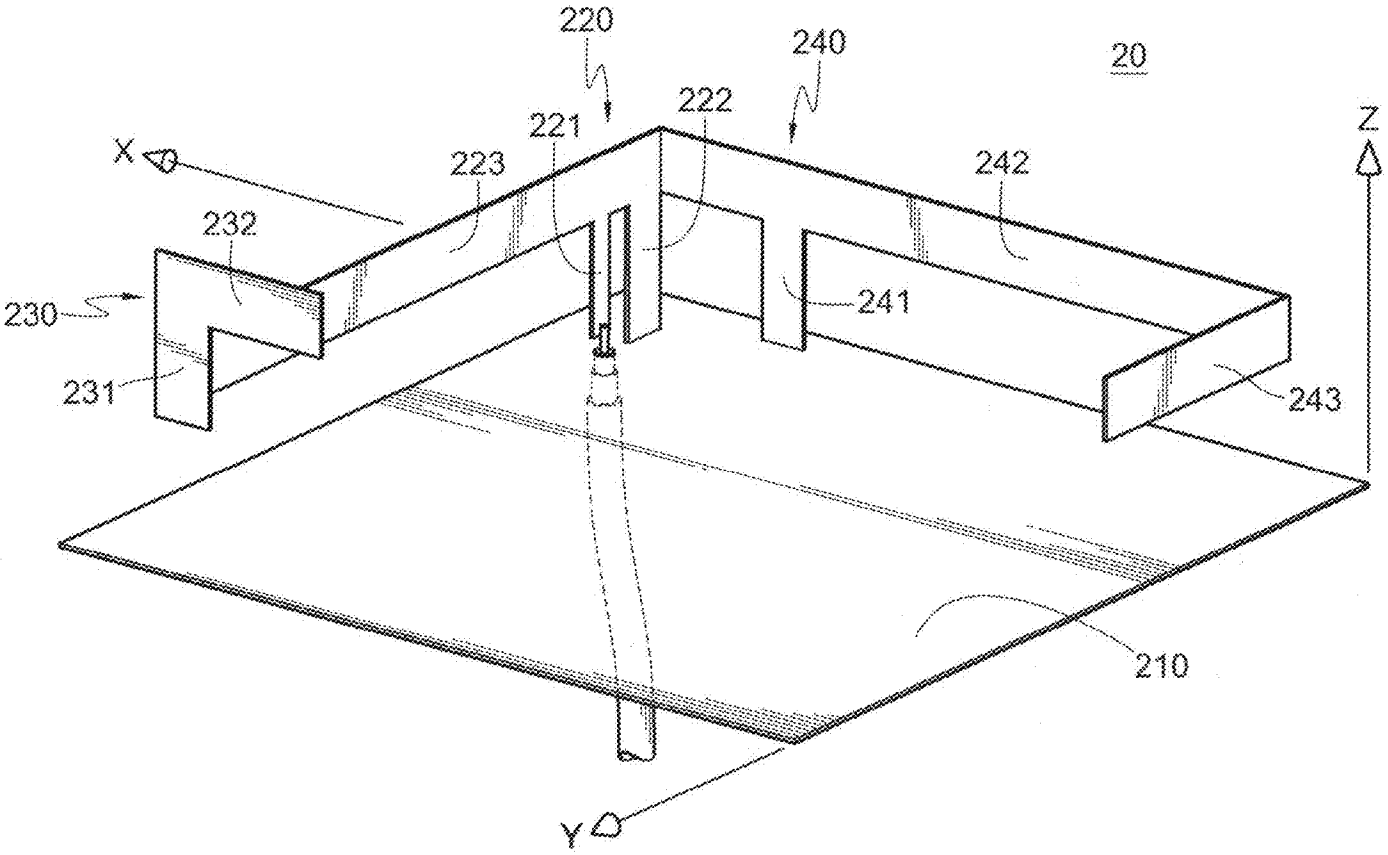
FIG. 4 is structural view of a dual-polarized antenna of a second embodiment according to the disclosure.
Figure 5:
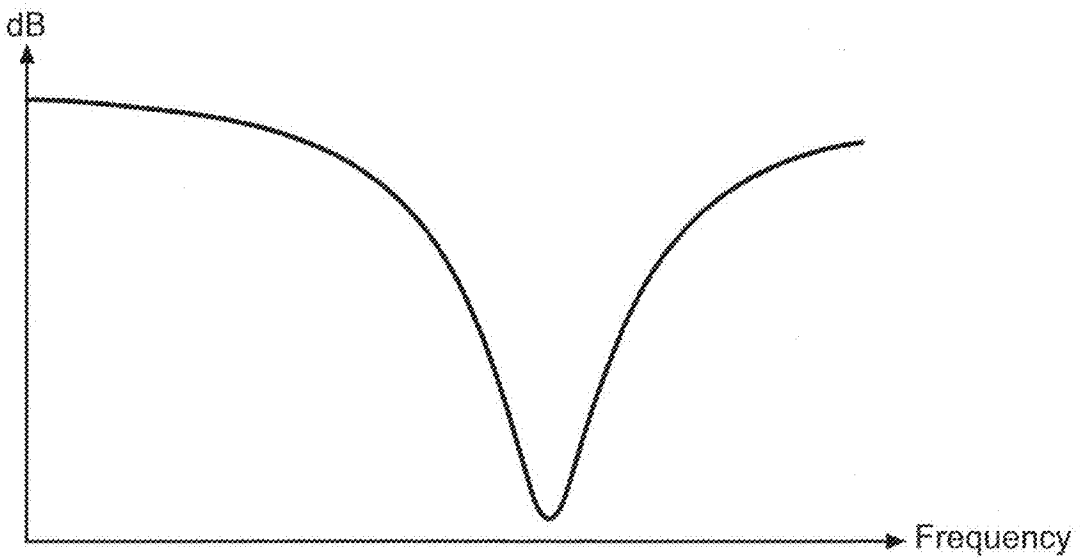
FIG. 5 is a curve of a reflection coefficient of a dual-polarized antenna in 865 MHz of a second embodiment according to the disclosure.
Figure 6A:
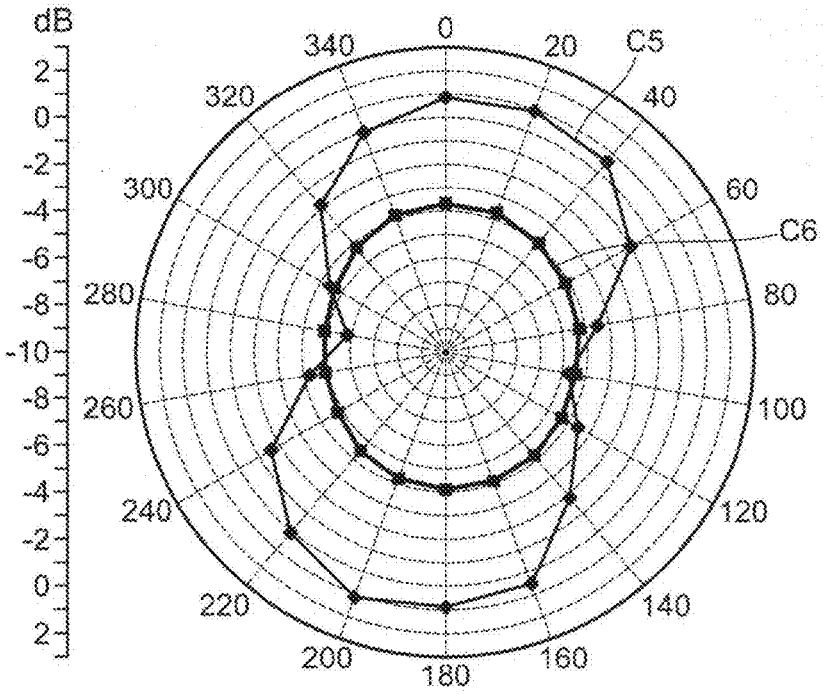
FIG. 6A is a two-dimensional radiation pattern on an X-Z or Y-Z plane of a dual-polarized antenna in 865 MHz of a second embodiment according to the disclosure.
Figure 6B:
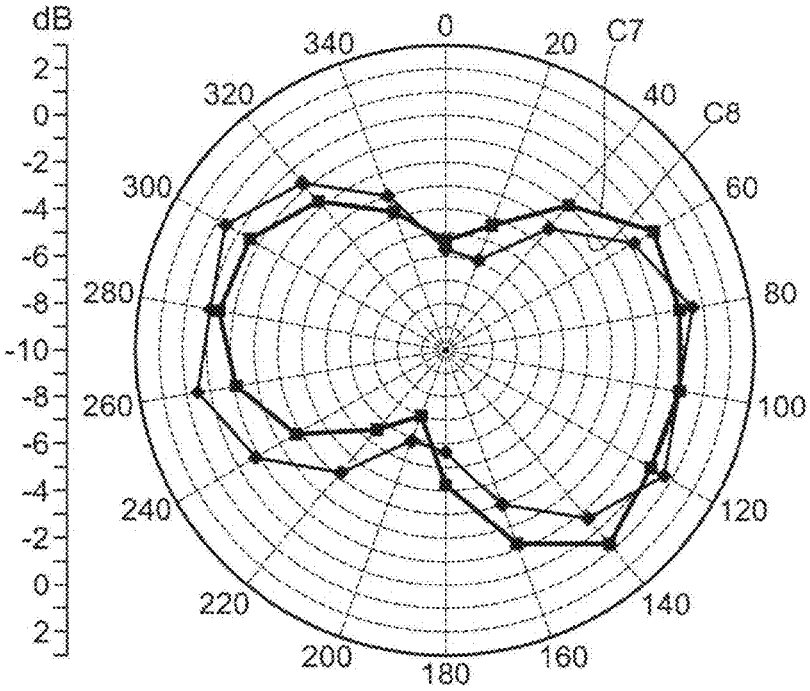
FIG. 6B is a two-dimensional radiation pattern on an X-Y plane of a dual-polarized antenna in 865 MHz of a second embodiment according to the disclosure.
Figure 8:
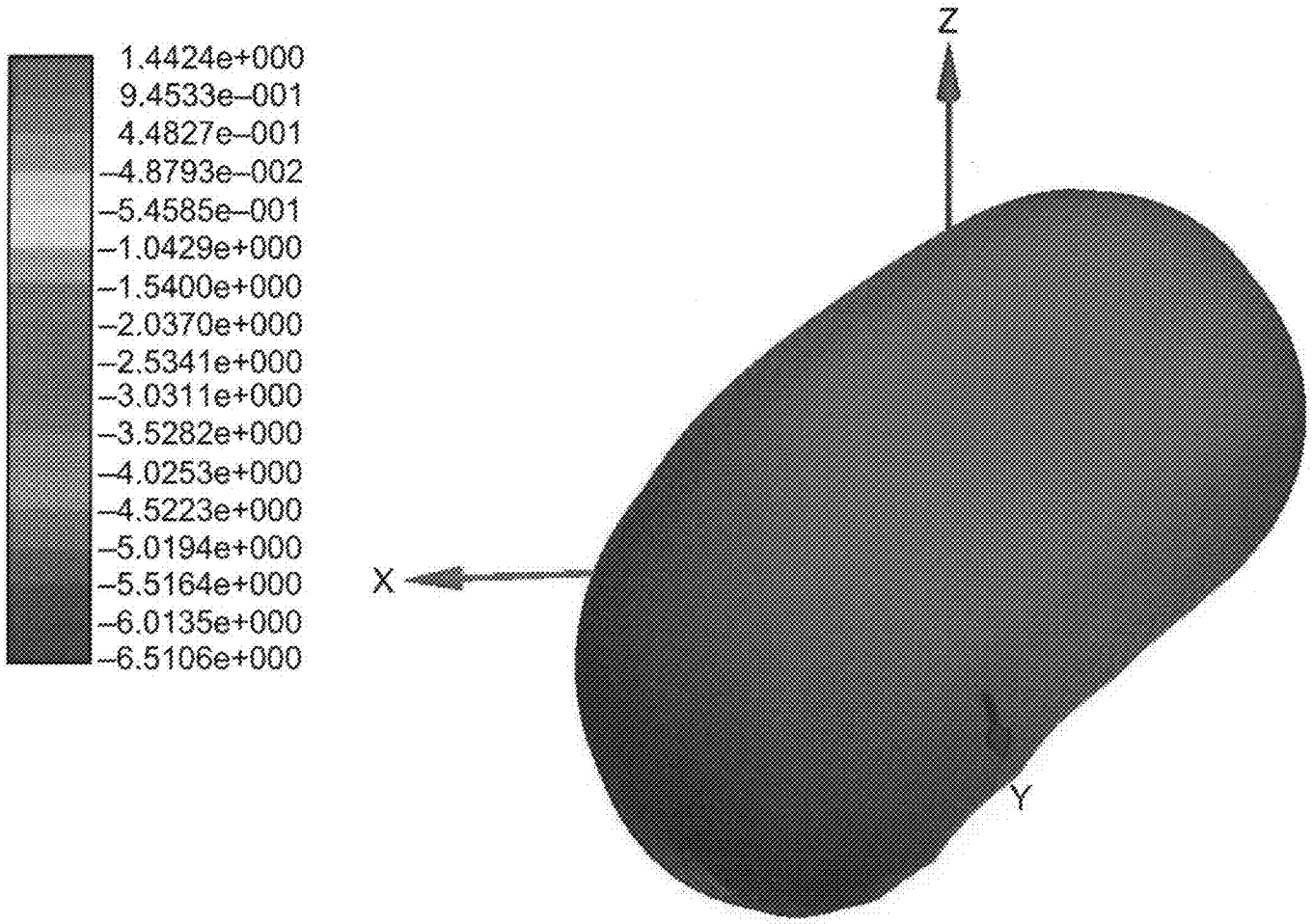
FIG. 8 is a three-dimensional radiation pattern on an X-Y plane of a dual-polarized antenna in 865 MHz of a second embodiment according to the disclosure.

Furthermore, a second embodiment is also provided by the disclosure, as referring to FIGS. 4 to 6B and FIG. 8. FIG. 4 is structural view of a dual-polarized antenna of a second embodiment according to the disclosure, FIG. 5 is a curve of a reflection coefficient of a dual-polarized antenna in 865 MHz of a second embodiment according to the disclosure, the FIG. 8 is a three-dimensional radiation pattern on an X-Y plane of a dual-polarized antenna in 865 MHz of a second embodiment according to the disclosure, FIG. 6A is a two-dimensional radiation pattern on an X-Z or Y-Z plane of a dual-polarized antenna in 865 MHz of a second embodiment according to the disclosure, FIG. 6B is a two-dimensional radiation pattern on an X-Y plane of a dual-polarized antenna in 865 MHz of a second embodiment according to the disclosure.

A dual-polarized antenna 20 provided by the disclosure includes a ground plane 210, an inverted-F conductor unit 220, an inverted-L conductor unit 230 and a stretched ground conductor unit 240. The inverted-F conductor unit 220, the inverted-L conductor unit 230 and the stretched ground conductor unit 240 are disposed on the ground plane 210, the inverted-F conductor unit 220 and the stretched ground conductor unit 240 are vertically connected with the ground plane 210, while the inverted-L plane unit 230 is vertically connected with the inverted-F conductor unit 220. Therefore, the inverted-F plane unit 220, the inverted-L plane unit 230 and the ground plane 210 are perpendicular to each other.

The inverted-F conductor unit 220 includes a signal-feeding conductor section 221, a stretched conductor section 222 and an arm conductor section 223. A first end of the signal-feeding conductor section 221 is connected with the ground plane 210 through a signal-feeding cable (not numbered), therefore there is a signal-feeding point at the connection between them. A first end of the stretched conductor section 222 is vertically extended from a surface of the ground plane 210, and a side of the stretched conductor section 222 perpendicular to the ground plane 210 is parallel to a side of the signal-feeding conductor section 221 perpendicular to the ground plane 210. A first end of a first side of the arm conductor section 223 is connected with a second end of the signal-feeding conductor section 221 and a second end of the stretched conductor section 222 respectively. A surface of the signal-feeding conductor section 221, a surface of the stretched conductor section 222 and a surface of the arm conductor section 223 are combined to form an inverted-F plane, and the inverted-F plane is perpendicular to the ground plane 210; in other words, the surface of the signal-feeding conductor section 221, the surface of the stretched conductor section 222 and the surface of the arm conductor section 223 are all perpendicular to the ground plane 210.

The inverted-L conductor unit 230 includes a stretched conductor section 231 and a branch arm conductor section 232. A first end of the stretched conductor section 231 is extended from a second side of the arm conductor section 223, and the second side of the arm conductor section 223 is adjacent and perpendicular to the first side of the arm conductor section 223. A first end of the branch arm conductor section 232 is connected to a second end of the stretched conductor section 231. A surface of the stretched conductor section 231 and a surface of the branch arm conductor section 232 are combined to form a surface of the inverted-L conductor unit 230, which is an inverted-L plane. The inverted-L plane is perpendicular to the ground plane 210, which means the surface of the stretched conductor section 231 and the surface of the branch arm conductor section 232 are perpendicular to the ground plane 210.

The stretched ground conductor unit 240 includes a stretched conductor section 241, an arm conductor section 242 and a stretched conductor section 243. A first end of the stretched conductor section 241 is vertically extended from the ground plane 210; and a side of the stretched conductor section 241 perpendicular to the ground plane 210 is parallel to the side of the stretched conductor section 222 perpendicular to the ground plane 210, and the side of signal-feeding conductor section 221 perpendicular to the ground plane 210.

A first end of a first side of the arm conductor section 242 is connected to a second end of the stretched conductor section 241, while a second side of the arm conductor section 242 is vertically connected to the inverted-F conductor unit 220. In other words, the second side of the arm conductor section 242 is vertically connected with a third side of the arm conductor section 223 which is adjacent to and perpendicular to the first side of the arm conductor section 223. Therefore, a surface of the stretched conductor section 241 and a surface of the arm conductor section 242 are combined to form a T-shaped plane, and the T-shaped plane is perpendicular to the ground plane 210, which means the surface of the stretched conductor section 241 and the surface of the arm conductor section 242 are perpendicular to the ground plane 210. The T-shaped plane is perpendicular to the inverted-F plane but the T-shaped plane is parallel to the inverted-L plane. An end of the stretched conductor section 243 is vertically extended from a third side of the arm conductor section 242 which is adjacent to and perpendicular to the first side of the arm conductor section 242. A surface of the stretched conductor section 243 is perpendicular to the surface of the arm conductor section 242 to form an L-shape, and the surface of the stretched conductor section 243 is perpendicular to the surface of the stretched conductor section 241.

A total length of the stretched conductor section 222, the arm conductor section 223, the stretched conductor section 231 and the branch arm conductor section 232 is a quarter of an operating wavelength of the dual-polarized antenna 20, while a total length of the stretched conductor section 222, the arm conductor section 242 and the stretched conductor section 243 is also a quarter of the operating wavelength of the dual-polarized antenna 20.

A boundary where the inverted-L conductor unit 230 and the arm conductor section 223 are connected, which is the second side of the arm conductor section 223, is adjacent to and perpendicular to the first side of the arm conductor section 223 which is connected to the signal-feeding conductor section 221 and the stretched conductor section 222. The inverted-F plane of the inverted-F conductor unit 220, the inverted-L plane of the inverted-L conductor unit 230, the T-shaped plane of the stretched ground conductor unit 240 and the surface of the stretched conductor section 243 correspond to four adjacent sides of the ground plane 210 respectively. The arm conductor section 223, the stretched conductor section 243 and the arm conductor section 242 are disposed above the ground plane 210 at a same height level.

A radiation intensity of the dual-polarized antenna 20 increases gradually from the stretched conductor section 222 to the inverted-L conductor unit 230, and increases gradually from the stretched conductor section 222 to the stretched conductor section 243. A ratio of lengths of the stretched conductor section 231 and the branch arm conductor section 232 of the inverted-L conductor unit 230, a ratio of lengths of the stretched conductor section 222 and the arm conductor section 223 of the inverted-F conductor unit 220, as well as a ratio of lengths of the arm conductor section 242 and the stretched conductor section 243 can be designed according to an applied device, provided that the total length of the stretched conductor section 222, the arm conductor section 223, the stretched conductor section 231 and the branch arm conductor section 232 is a quarter of the operating wavelength of the dual-polarized antenna 20, while the total length of the stretched conductor section 222, the arm conductor section 242 and the stretched conductor section 243 is also a quarter of the operating wavelength of the dual-polarized antenna 20.

A radiation of the dual-polarized antenna 20 in a Z-axis direction is shown in a radiation pattern in FIG. 8. As shown in FIGS. 6A and 6B, curves C5 and C8 are acquired by measuring in zero degree, while curves C6 and C7 are acquired by measuring in 90 degrees.

The ground plane in each of the embodiments provided by the disclosure is a rectangular radiation guiding plane for guiding a radiation emitted from the dual-polarized antenna in one direction. Therefore, the radiation direction of the dual-polarized antenna of the disclosure can be perpendicular to the surface of the ground plane according to designs, which is a Z-direction as shown in FIGS. 2, 3A, 3B, FIG. 7, FIGS. 5, 6A, 6B and FIG. 8. In each of the embodiments, a ratio of lengths of the stretched conductor section and the branch arm conductor section of the inverted-L conductor unit, as well as a ratio of lengths of the stretched conductor section and the arm conductor section of the inverted-F conductor unit can be designed according to an applied device and the required operating frequency band, provided that a total length is a quarter of the operating wavelength of the dual-polarized antenna.

The embodied forms of the disclosure are applicable for wireless transmitting technology of ISO18000-6C radio frequency identification to operate between a frequency of 860 MHz and 960 MHz for use in RFID read-write devices. However the disclosure is not limited by it. Therefore, the dimensions of the dual-polarized antenna can be designed according to demands and requirements of users, so that an applicability of the dual-polarized antenna can be enhanced by enhancing a radiation efficiency of the antenna and reducing the production costs.

Note that the specifications relating to the above embodiments should be construed as exemplary rather than as limitative of the present invention, with many variations and modifications being readily attainable by a person of average skill in the art without departing from the spirit or scope thereof as defined by the appended claims and their legal equivalents.

What is claimed is:

1. A dual-polarized antenna, comprising:

a ground plane;

an inverted-F conductor unit disposed on the ground plane, comprising:

a first stretched conductor section, a first end of the first stretched conductor section being extended from the ground plane;

a signal-feeding conductor section, a side of the signal-feeding conductor section perpendicular to the ground plane being parallel to a side of first stretched conductor section perpendicular to the ground plane, and a first end of the signal-feeding conductor section being connected with the ground plane through a signal-feeding cable; and a first arm conductor section, a first end of a first side of the first arm conductor section being connected with a second end of the first stretched conductor section and a second end of the signal-feeding conductor section to form an inverted-F plane; and an inverted-L conductor unit being connected with the inverted-F conductor unit, and a surface of the inverted-L conductor unit, the inverted-F plane of the inverted-F conductor unit and a surface of the ground plane being perpendicular to each other.

2. The dual-polarized antenna as claimed in claim 1, wherein a surface of the first stretched conductor section, a surface of the signal-feeding conductor section and a surface of the first arm conductor section are combined to form the inverted-F plane of the inverted-F conductor unit.

3. The dual-polarized antenna as claimed in claim 1, wherein the ground plane is a radiation guiding plane, a radiation direction of the dual-polarized antenna is perpendicular to the surface of the ground plane.

4. The dual-polarized antenna as claimed in claim 1, wherein the inverted-L conductor unit comprises:

a second stretched conductor section, a first end of the second stretched conductor section is extended from a second side of the first arm conductor section; and a branch arm conductor section, a first end of the branch arm conductor section is connected to a second end of the second stretched conductor section.

5. The dual-polarized antenna as claimed in claim 4, wherein a surface of the second stretched conductor section and a surface of the branch arm conductor section are combined to form the surface of the inverted-L conductor unit.

6. The dual-polarized antenna as claimed in claim 4, wherein a total length of the first stretched conductor section, the first arm conductor section, the second stretched conductor section and the branch arm conductor section is a quarter of an operating wavelength of the dual-polarized antenna.

7. The dual-polarized antenna as claimed in claim 4, wherein the second side of the first arm conductor section connected to the inverted-L conductor unit is adjacent to and perpendicular to the first side of the first arm conductor section connected to the signal-feeding conductor section and the first stretched conductor section.

8. The dual-polarized antenna as claimed in claim 4, wherein the inverted-F plane of the inverted-F conductor unit and the surface of the inverted-L conductor unit correspond to two adjacent sides of the ground plane respectively.

9. The dual-polarized antenna as claimed in claim 1, wherein a radiation intensity of the dual-polarized antenna increases gradually from the first stretched conductor section to the inverted-L conductor unit.

10. The dual-polarized antenna as claimed in claim 1, wherein the ground plane is rectangular.

11. The dual-polarized antenna as claimed in claim 1, further comprising:

a stretched ground conductor unit extended vertically from the ground plane, and being connected with the inverted-F plane.

12. The dual-polarized antenna as claimed in claim 11, wherein the stretched ground conductor unit comprises:

a third stretched conductor section, a first end of the third stretched conductor section is extended vertically from the ground plane;

a second arm conductor section, a first side of the second arm conductor section is connected to a second end of the third stretched conductor section, a second side of the second arm conductor section is connected to the inverted-F plane, and the second arm conductor section and the third stretched conductor section are combined to form a T-shaped plane; and a fourth stretched conductor section extended from a third side of the second arm conductor section.

13. The dual-polarized antenna as claimed in claim 12, wherein a surface of the fourth stretched conductor section is perpendicular to a surface of the second arm conductor section to form an L-shape, and the surface of the fourth stretched conductor section is perpendicular to a surface of the third stretched conductor section.

14. The dual-polarized antenna as claimed in claim 12, wherein the second arm conductor section, the fourth stretched conductor section and the first arm conductor section are disposed above the ground plane at a same height level.

15. The dual-polarized antenna as claimed in claim 12, wherein the surface of the first arm conductor section, the surface of the inverted-L conductor unit, a surface of the second arm conductor section and a surface of the fourth stretched conductor section correspond to each of the sides of the ground plane respectively.

16. The dual-polarized antenna as claimed in claim 12, wherein a radiation intensity of the dual-polarized antenna increases gradually from the first stretched conductor section to the inverted-L conductor unit and the fourth stretched conductor section respectively.

17. The dual-polarized antenna as claimed in claim 12, wherein a total length of the third stretched conductor section, the second arm conductor section, the second stretched conductor section and the fourth stretched conductor section is a quarter of an operating wavelength of the dual-polarized antenna.

* * * * *